United States Patent [19]

Belony

[11] 4,288,079

[45] Sep. 8, 1981

[54] GAME APPARATUS

[76] Inventor: Jean-Claude M. J. Belony, 2803 Keith St., Marlow Heights, Md. 20031

[21] Appl. No.: 67,192

[22] Filed: Aug. 16, 1979

[51] Int. Cl.[3] ..... A63F 3/00

[52] U.S. Cl. ..... 273/273; 273/236

[58] Field of Search ..... 273/236, 265, 267, 269, 273/272, 276, 282, 271, 273

[56] References Cited

U.S. PATENT DOCUMENTS

| | | | |
|---|---|---|---|
| 557,205 | 3/1896 | Hinckley | 273/236 X |
| 806,624 | 12/1905 | Becker | 273/236 X |
| 1,571,488 | 2/1926 | Moisan | 273/236 |
| 3,169,769 | 2/1965 | Cornish | 273/282 X |
| 3,175,825 | 3/1965 | Ehret | 273/236 X |
| 3,402,934 | 9/1968 | Adams | 273/236 X |
| 3,405,943 | 10/1968 | Marsh | 273/236 X |
| 3,484,108 | 12/1969 | Geiger | 273/236 X |
| 3,819,184 | 6/1974 | McPhail | 273/282 X |
| 4,139,199 | 2/1979 | Drummond | 273/243 |
| 4,149,727 | 4/1979 | Penney | 273/271 |

*Primary Examiner*—Harland S. Skogquist
*Attorney, Agent, or Firm*—Fleit & Jacobson

[57] ABSTRACT

A game apparatus for use in playing a game which includes a plurality of distinct playing pieces, a game board and dice for determining by chance which pieces are available to be played and where on the game board they may be played.

19 Claims, 7 Drawing Figures

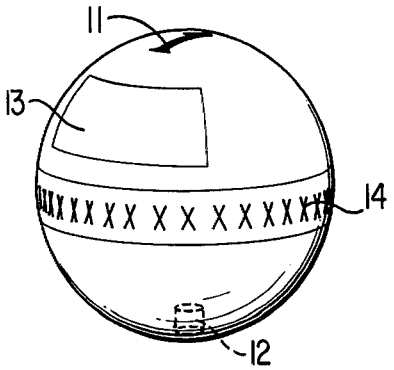
FIG. 3
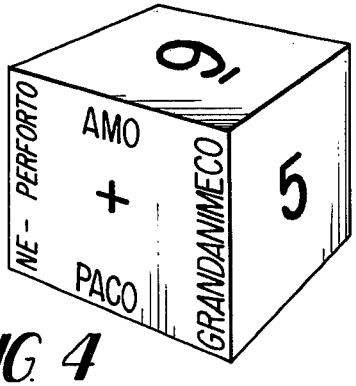
FIG. 4
FIG. 5a
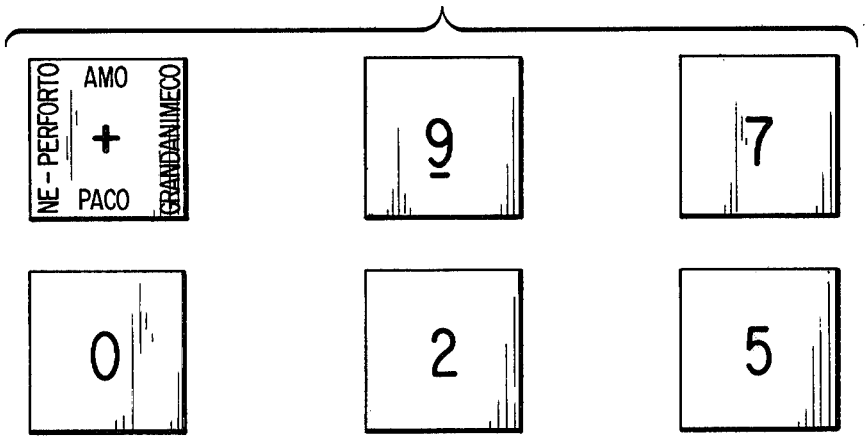
FIG. 5b
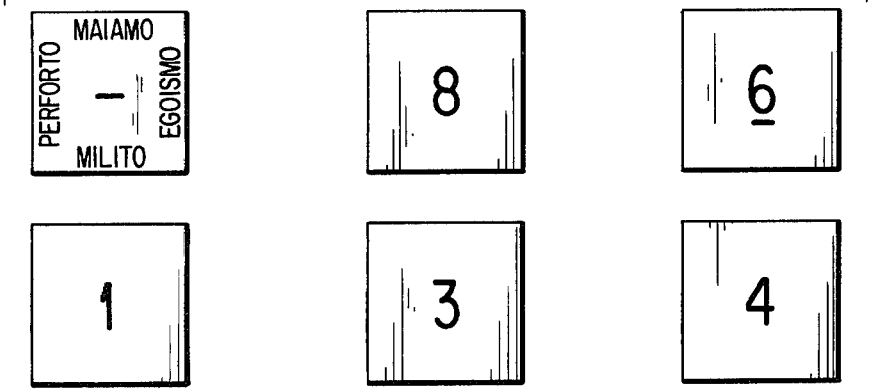

GAME APPARATUS

BACKGROUND OF THE INVENTION

The present invention relates to an apparatus for use in playing a game. More specifically, the present invention relates to a game apparatus which employs a plurality of playing pieces, a game board and means for determining by chance both the pieces which may be played and where they may be placed on the game board.

SUMMARY OF THE INVENTION

The present game apparatus includes a number of distinct playing pieces bearing means thereon to indicate their distinctness, a gameboard which may include two playing sections and a neutral section therebetween, and means for determining by chance which pieces are available to be played and in which of the subsections of the playing section of the board these pieces may be played. In addition, the game may include elements which foster international cooperation and peace. The game is enjoyable to play and gives a great opportunity for individual strategy.

BRIEF DESCRIPTION OF THE DRAWINGS

FIG. 3 is a perspective view of a preferred embodiment of a playing piece constructed according to the present invention.

FIG. 4 is a perspective view of a preferred embodiment of a die constructed according to the present invention.

FIG. 5*a* is a view of six faces of a die in accordance with the present invention.

FIG. 5*b* is a view of six faces of another die in accordance with the present invention.

DESCRIPTION OF THE PREFERRED EMBODIMENTS

The game apparatus of the present invention includes three basic parts, playing pieces, a game board and chance means. These parts are first described individually, after which follows a description of the rules and objects of the game.

The Game Board

Figure 1:
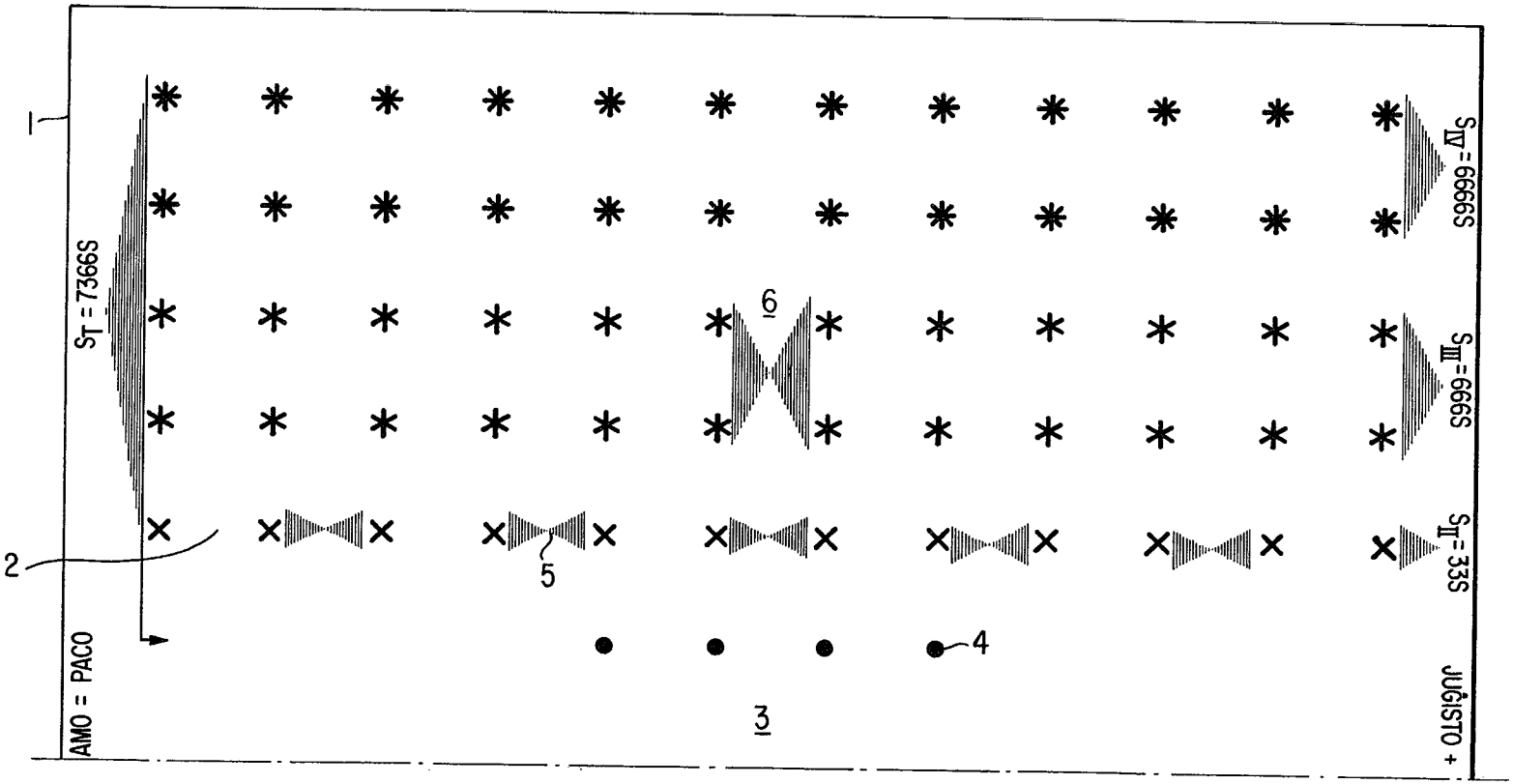
FIG. 1 is a diagrammatic representation of one half of a game board constructed in accordance with one aspect of the present invention.

FIG. 1 is a diagrammatic representation of a preferred embodiment of one half of a game board constructed in accordance with the present invention. The board 1 shown in FIG. 1 includes a playing section 2, and one half of a neutral section 3. A complete board would include another identical half which would have a complementary portion of the neutral section and another identical playing section. In this embodiment, each playing section includes 64 separate means for receiving playing pieces which are sometimes referred to as "men" because, in a preferred embodiment, they are constructed in the shape of a man.

In the illustrated embodiment, the playing section is divided into four subsections called Section I, Section II, Section III and Section IV. These subsections may also be referred to as the first section, second section, third section and fourth section. Each subsection of a playing section typically includes one type of man. The illustrated embodiment, thus, would employ four types of men, namely one-variable-men, two-variable-men, three-variable-men and four-variable-men (The term "dimension" is sometimes substituted for the term "variable".).

The first section includes four one-dimension-men, shown as four dots 4 in FIG. 1. This means that each man, or playing piece receiving means, is adapted to receive one playing piece, and by the specific rules disclosed herein, may receive only one playing piece.

The second section, $S_{II}$, of the playing section illustrated in FIG. 1 includes twelve two-dimension-men. These men, which are adapted to receive two playing pieces, are shown as six pairs of men with each pair separated from another pair by either indicia or physical means. The means separating the men 5 in a preferred embodiment is called a "red-fence" or "fence".

The third section, $S_{III}$ in FIG. 1, includes four groups of six, or twenty-four, three-dimension-men each of which is adapted to receive three playing pieces. In FIG. 1, each group of six men are separated from an adjacent group. As shown in FIG. 1, the separating means 6, either indicia or physical means, is called the "big-red-fence" or "central fence".

The fourth section, $S_{IV}$ in FIG. 1, includes twenty-four "four-dimension-men" each of which are adapted to receive four playing pieces. In the illustrated embodiment, this section contains no separating means.

It is not necessary for the game board to be divided into sections nor are four sections or multi-variable men required. Any number of sections, men or variables may be employed without departing from the scope of this invention. In fact, a game for younger players may include only a section such as $S_{IV}$ as described above, and the winner may be determined simply by whoever fills his board first.

Although the men will be fully described hereinafter, it should be noted now that a pair of men is formed by two men of two identical variables and a group of men is formed by six men of three identical variables. These variables, however, are not arranged in the same way in the different pairs or groups of men.

Each section of the playing section of the game board in accordance with this invention may be assigned a mathematical value. This value is indicated on FIG. 1 for each of the second, third and fourth sections. The value of the first section is represented as s or $S_1=s$. The value of the second section is 33s, so $S_2=$33s. The value of the third section is 666s, so $S_3=$666s. The value of fourth section is 6666s, so $S_4=$6666s. Thus, the mathematical value of the four sections equal $S_1+S_2+S_3+S_4=7366s$.

In a specific case, if each of the variables or dimensions of the men, the piece receiving means, are replaced by a specific numeral, each man will then represent a number having the number of digits corresponding to the number of dimensions of the man. If the numbers are formed and read according to the specific rules herein described, and if these numbers are all added together, their total will equal the mathematical value of the section. That is, each section will have a value corresponding to the value assigned to it. All that is required to find a specific total is the value of s, which is the arithmetic sum of the numerals chosen to replace the variables on the men in Section I. In the play of the game and for practical reasons, it is preferable that the four numerals be different from one another, although it is possible for them to be the same.

Finally, in a preferred embodiment, the game board of the present invention includes a neutral section or zone 3. This neutral section is reserved basically for throws of the dice and other transactions. The space may be of any convenient size and may include any designs or paintings or the like for symbolic and aesthetic reasons.

Figure 2A:
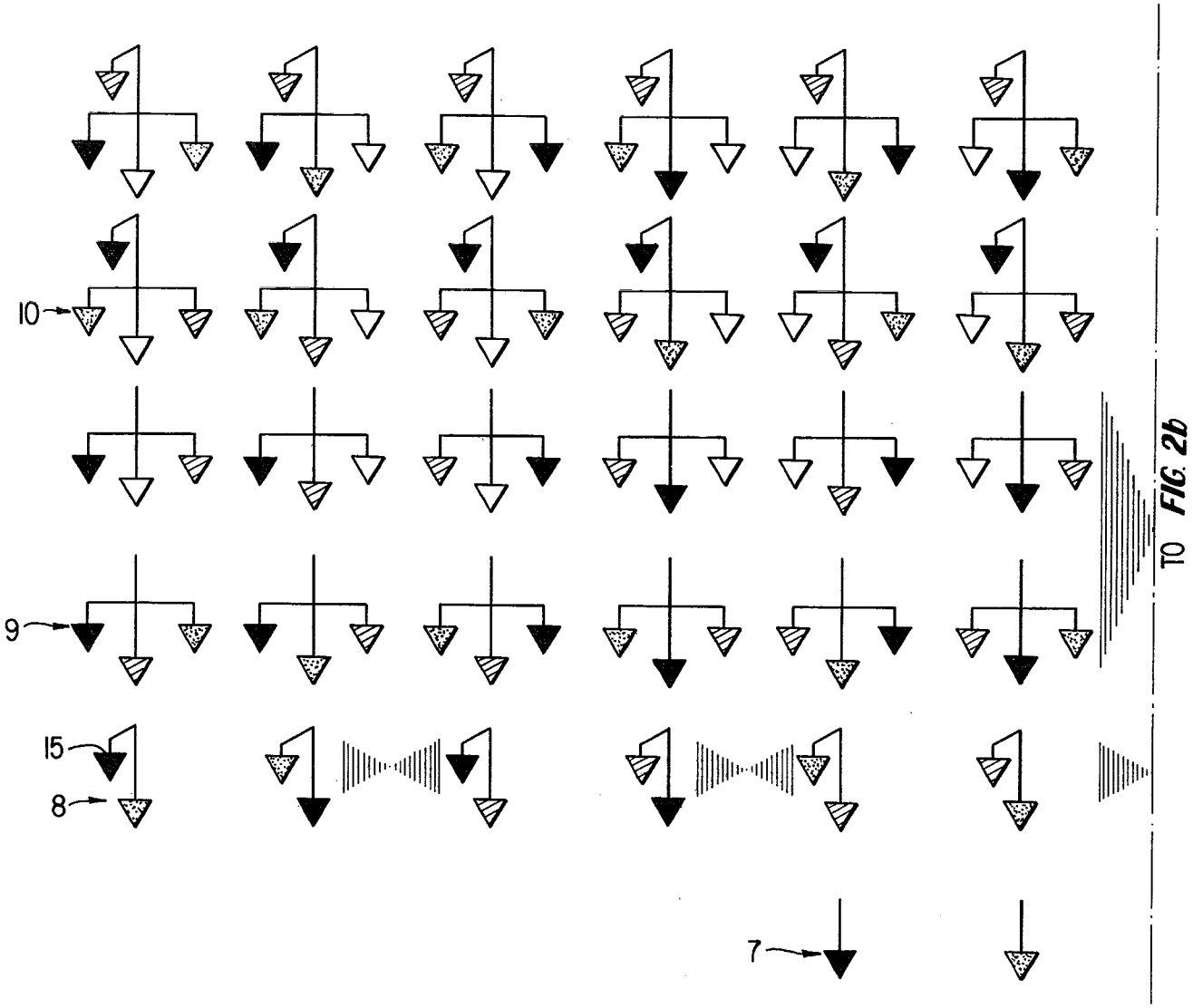
FIGS. 2*a* and 2*b* are a schematic representation of the playing section of the board of FIG. 1.
Figure 2B:
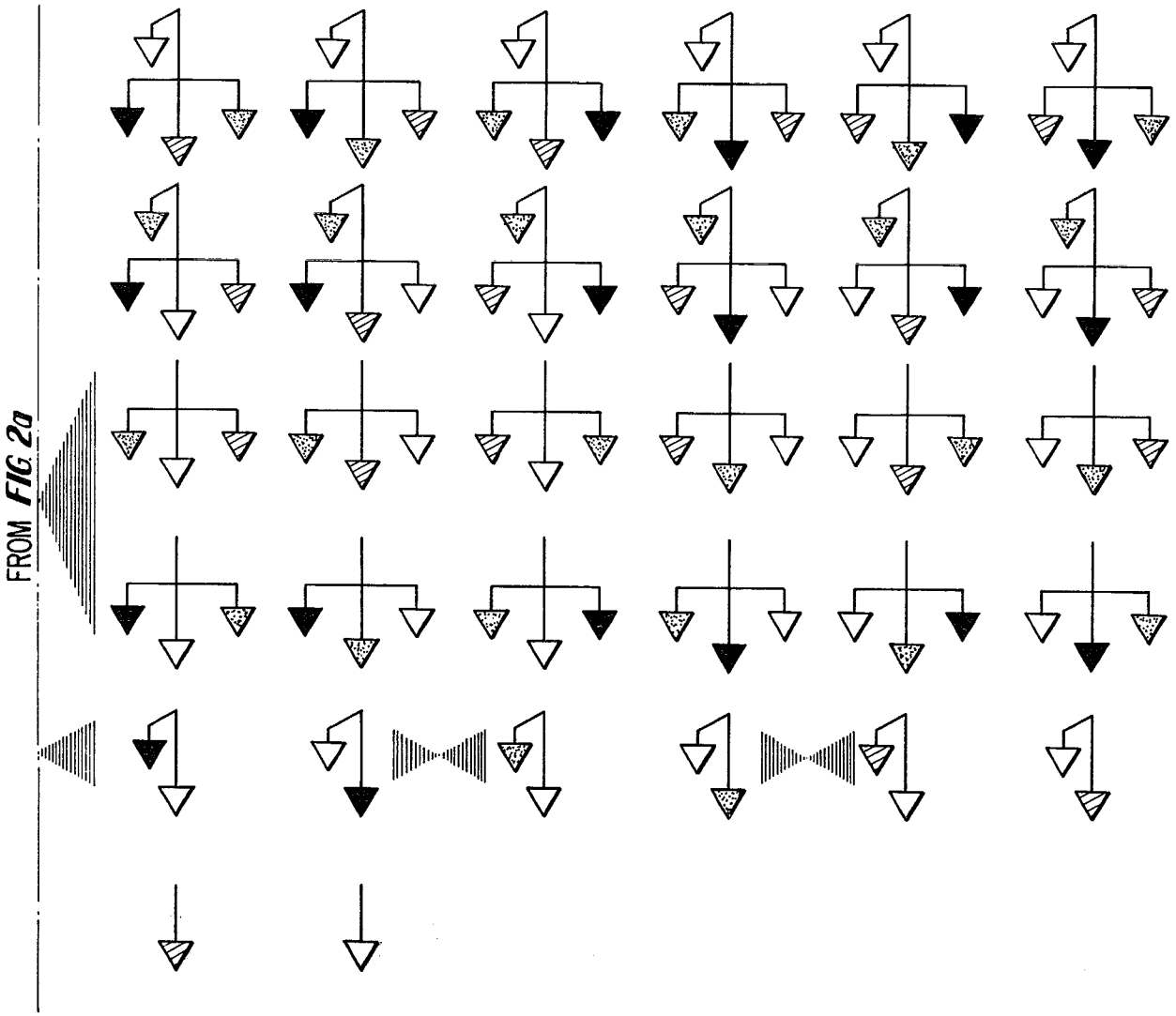

The means for receiving the playing pieces, or men, are now described in detail with reference to FIGS. 2*a* and 2*b* which are a schematic representation of the single playing section of the board portion of FIG. 1. The means for receiving playing pieces may have any suitable shape. They may even simply be markings on a flat game board surface. In a preferred embodiment, however, these devices have the shape of a man. The men represent a possible combination of four elements (playing pieces) taken either one to one or two to two or three to three or four to four.The first section of the board typically includes men representing one to one combinations. Man 7 in FIG. 2*a* is a representative one-dimension man. The second section of the board typically includes men representing two to two combinations. Man 8 in FIG. 2*a* is a representative two-dimension man. The third part of the board typically contains men representing three to three combinations. Man 9 in FIG. 2*a* is a representative three-dimension man. The fourth section of the board typically contains men representing four to four combinations. Man 10 in FIG. 2*a* is a representative four-dimension man. Thus, the schematic in FIGS. 2*a* and 2*b* shows a total of 64 men representing 64 possible combinations of four elements taken in the above mentioned combinations. This is the total number of possible combinations with four different elements.

In a preferred embodiment, the piece receiving means are shaped like men with the terminal portion of each element of each man adapted to receive and display a playing piece. In a preferred embodiment disclosed herein, these pieces are balls having a hole to be placed at the end of a projection at the top of each element in the man. As will be discussed in detail in connection with a set of rules for playing the present game, the men must be filled in a specific order, namely from bottom to middle right to middle left to top.

The Playing Pieces

Although the playing pieces can be any means capable of bearing indicia, in a preferred embodiment, they are simply small round colored balls which have a number associated therewith, which may be borne on the top of the ball. In the embodiment described herein, each ball is colored with one of ten preselected colors, and each ball bears a one-digit numeral selected from the group consisting of 0, 1, 2, 3, 4, 5, 6, 7, 8 and 9. A typical ball used as a playing piece in accordance with this invention is shown in perspective in FIG. 3. The piece shown in FIG. 3 includes a one-digit number 11, and means by which the piece is adapted for receipt by the playing piece receiving means, hole 12 in FIG. 3.

The playing pieces may also bear additional indicia such as the flag of a country or an international body such as the United Nations. In a preferred embodiment, the flag would be placed in the space 13 in FIG. 3. In addition, in a preferred embodiment, the sentence "justice plus love equals peace", written in the language of the country represented by the flag borne by the piece can be written around the circumference of the playing piece. The preferred space for writing the sentence is indicated as 14 in FIG. 3. If the flag placed on the piece represents an international organization, the above-mentioned sentence should preferably be written in esperanto.

In the embodiment shown in FIG. 2, 196 pieces are required to entirely fill all of the men. Since the men are filled with four different types of playing pieces or balls of the 10 types employed in a preferred embodiment of the game, each player should have a total of 49 of each kind of ball. Because it is unknown which of the types of balls will be used by a particular player in each game (that depends on the chance means), each player should have 49 balls of each type for a total of 490 balls.

Chance Means

Although any means for randomly indicating numbers or colors or the like can be employed, dice are used in a preferred embodiment of this invention. A perspective view of a preferred embodiment of a die constructed according to the present invention is shown in FIG. 4.

In a preferred embodiment of the game, eight or four pairs, of dice are used. All of the dice may bear indicia corresponding to the indicia borne by the playing pieces. These indicia may be colors, letters or, as described here, the numerals from 0 to 9 (1-digit numerals). In a preferred embodiment, all of the dice bear one of these numerals on five of their faces, while the sixth face bears a different symbol, which in a preferred embodiment is either a plus (+) or a minus (−). In addition, other indicia may be placed on the face bearing the symbol. These may be, for example, certain fundamental words designed to instill positive values in a person. In one embodiment of the game, the words are written in esperanto to encourage people to understand a common international language.

In a game constructed in accordance with this invention which employs numerals on the dice, the dice may be divided into two categories. The dice of the first category include five one-digit numerals having an arithmetical sum of 23 on five of its faces and a plus (+) at the center of the sixth face with four positive words around its circumference. The faces of a typical die of the first type is shown in FIG. 5. A die of the second type also has five numerals on five of its faces, one to a face, the sum of which is equal to 22. On the sixth face, there typically is a minus (−) at the center and four negative words surrounding the minus sign. A typical die of the second type is shown in FIG. 5*a*.

In a preferred embodiment of a game constructed according to this invention, the eight dice may be constructed as follows:

TABLE I

| | FACES OF THE DICE | | | | | |
|---|---|---|---|---|---|---|
| DIE | 1 | 2 | 3 | 4 | 5 | 6 |
| A | 0 | 2 | 5 | 7 | 9 | + |
| B | 1 | 3 | 4 | 6 | 8 | − |
| C | 0 | 3 | 5 | 6 | 9 | + |
| D | 1 | 2 | 4 | 7 | 8 | − |
| E | 0 | 3 | 4 | 7 | 9 | + |
| F | 1 | 2 | 5 | 6 | 8 | − |
| G | 2 | 3 | 4 | 5 | 8 | − |
| H | 0 | 1 | 6 | 7 | 9 | + |

The positive words to be placed on the face of a die bearing a plus sign may be selected from the following suggested esperanto words:

amo, paco, juĝisto, saĝeco, vareco, egaleco, libereco, progresso, laboro, unuiĝo, grandanimeco, tolerado, infano protektiĝo, vicina liberago, homaj rajtoj; and ne-perforto.

The negative words that are placed on the face of the die bearing the minus sign may be selected from the following suggested esperanto words:

milito, malamo, maljusteco, malvirto, mensogo, malegaleco, sklaveco, malunueco, virina servitego, infana perfortigo, malprogresso, rasismo, neokupata, distingado, egoismo and perforto.

For the convenience of the players, where numbers are employed on the dice, each numeral can be colored to correspond with the playing piece having the same number thereon so that it is easy to choose the playing piece by sight of the face of the dice. Of course, the dice may simply bear colors, letters or other suitable indicia which correspond to the indicia on the playing pieces.

In playing a game in accordance with the present invention, if eight dice are employed, the dice may be thrown all at once or in two groups of four. The roll of the dice determines both which pieces may be played and where they may be placed on the board. This feature is more fully discussed in connection with a set of rules that may be employed to play a game with the game apparatus herein described.

Object And Rules Of The Game

The following set of rules assume the use of a four dimension playing board, eight dice as described above, and numerical balls bearing both numbers and colors. If other variants of the pieces are employed, other rules and methods of scoring will readily become apparent to those skilled in the art. The set of rules described herein relates to a game in which the object is to win the world prize of peace or the world prize of peace and wisdom. The object of the game described is for each of two players to try to fill up all the men on his part of the game board by the throws of the 8 special dice.

First, the game begins by choosing who will play first. The two players, in alternate turns, use the four dice which bear the plus (+) sign and throw them four consecutive times. The player accumulating the most plus signs is the first player, and the other plays second.

The first player then begins the play of the game. His object is to try to collect, in one throw, four different numerals by the throw of all eight dice. When he obtains four different numerals, the player takes the four numerical balls which correspond to these four different numerals and placed them on the head of each one of the four one-dimension-men in the first section of the board. The pieces must be placed in ascending numerical order from left to right. After a player fills up the first section, to have the right to play in any one of the three other sections, the player must satisfy certain conditions which are determined by the roll of the dice.

When a player accumulates four plus signs, he may play anywhere in the fourth section of the board, anywhere in the third section of the board, or anywhere in the second section of the board. If the player accumulates only three plus signs, he may play in only one group among the four groups of combinations of the third section, i.e., in one area only or in only three pairs of combinations of the six pairs of combinations in the second section of the board, i.e., in any three of the six areas of that section. If the player has only two plus signs, he may play only in one pair of combinations of the six pairs of combinations in the second section of the board.

Since there are so many sections, and so many areas, it is important for the player to be sure where he can or cannot play. For this reason, a few small green flags may be provided for each player to mark a section where they can play until a ball is actually played therein.

To assure proper scoring where numbers are employed, the numerical balls must be placed from the bottom to the top, from the legs to the head and from the right hand to the left hand on a particular man. Thus, in filling up a four dimension man, the legs are filled first, the right arm second, the left arm third, and finally the head is filled. This order of play is followed for every section regardless of the number of dimensions of the men in that section.

As noted previously, to ensure that the proper mathematical value for a particular subsection is reached in the numerical embodiment, the order of placement of the pieces of the men is critical. Moreover, once the first four numerical balls are placed on the one-dimension men, the pieces later played must be positioned on the variable corresponding to the single variable on which each piece is played. For example, a piece bearing the number 4 is placed on man 7 in FIG. 2*a*, any piece bearing the same number played later must be placed on a variable corresponding to the one represented by man 7, variable 15 on piece 8 in FIG. 2*a*, for example. The relationship of the variables directing the placement of the pieces is shown by the cross-hatching in FIGS. 2*a* and 2*b*. Of course, when no numbers are employed, the specific order of filling the men is not critical. Where necessary, however, the men may bear indicia, such as color, to help the player place the pieces properly.

When a player collects four plus signs, he not only can choose to play in any one of the sections of the board, but can also choose to take the right to play another consecutive turn, take the right to place four numerical balls anywhere he is allowed to play, or take the right to push out any four balls from a section or area of the other player. The player has the right to decide among these possibilities, thus allowing for a great deal of strategy in the play of the game.

When a player collects 4 minus signs, he may choose among the following plays. He may move any four of his balls from his section or he may ask the other player to either take the right to play the next consecutive time or to place four balls anywhere on its board that he is allowed to play. When a player collects four minus signs, he automatically loses the right to use the other faces of the dice. In addition, a player who had the right to play in a certain section or area of the board loses that right if the last ball or balls he had played there are removed from that section by either him or his opponent. To reobtain the right to play in a lost section, the player must satisfy the same conditions he originally satisfied to obtain that right. No balls, however, may be removed from the first section of the board. Furthermore, the number of balls which can be removed, at one time, from each section or area of the board is limited to two balls from the second section, three balls from the third section and four balls from the fourth section.

When a player collects a combination of plus and minus signs, the following rules apply. If there are more minus than plus, only the minus are counted. Likewise, if there are more plus than minus, only the plus are counted. Finally, if there are the same number of plus and minus, they cancel each other and neither are counted.

The game ends when one player has finished filling up his board or his 64 men with the pieces or numerical balls. Since this described embodiment of the game is a peace and wisdom game, allowing everyone to profit from his works, there is an opportunity for each player to win something. Thus, there is no winner or loser if the first player to fill his board or all his men accomplishes this feat only after either the second player had completely filled 62 of his men, irrespective of the arrangement of the two other men, or the second player had completely filled 60 of his men with the other 4 men being partially filled, i.e., having at least 1 ball. There is a loser and a winner, however, if when one player finishes filling his men the other player does not meet either of these conditions.

The game may be scored by giving each player a total of points equal to the mathematical value of each section of the board for each completely filled section. So, a total of 33 times the sum of the numerals borne by the four numerical balls is given to a player filling the second section. A total of 666 times the sum of the same balls is given to a player completely filling the third section. Finally, a total of points equal to 6,666 times the sum of the four different balls is given to a player for completely filling the fourth section. No points are given for the first section itself. The winner of four successive games is awarded an additional 542,000 points When a player reaches a total 250,000 points, he receives the world prize of peace, and when he reaches a total of 1,000,000 points, he receives the world prize of peace and wisdom.

Mathematical Basis

In a preferred embodiment, all the men found on the board represent all the possible numbers, which can be obtained by successively taking a number (n) of numerals one to one, two to two, three to three, four to four, n to n.

The mathematical value for such subsection of a playing section is given by my following formula:

$$\Sigma_m^n = \underset{(m)}{|}\left[\frac{(n-1)!}{(n-m)!}\right]s$$

in this formula:

n is the number of numerals (variables) involved in the game m is the number of numerals taken at a time or together s is the sum of the numerals found in the game or in each section

| when $m = 1$, | $= 1$
| $m = 2$, | $= 11$
| $m = 3$, | $= 111$
| $m = 4$, | $= 1{,}111$
| $m = 5$, | $= 11{,}111$
and so on A game where the number of variables is equal to four (4) is called a four variable game. So, in the first section (where m=1), the general formula becomes:

$$\Sigma_1^4 = \underset{(1)}{|}\left[\frac{(4-1)!}{(4-1)!}\right]s = \left[\frac{3!}{3!}\right]s = s$$

in the second section (where m=2), the general formula becomes:

$$\Sigma_2^4 = \underset{(2)}{|}\left[\frac{(4-1)!}{(4-2)!}\right]s = 11\left[\frac{3!}{2!}\right]s = 33s$$

in the third section (where m=3), the formula becomes:

$$\Sigma_3^4 = \underset{(3)}{|}\left[\frac{(4-1)!}{(4-3)!}\right]s = 111\left[\frac{3!}{1!}\right]s = 666s$$

and in the fourth section (where m=4), the formula becomes:

$$\Sigma_4^4 = \underset{(4)}{|}\left[\frac{(4-1)!}{(4-4)!}\right] = 1{,}111\left[\frac{3!}{0!}\right]s = 6{,}666s$$

As can be seen, a game could be also easily made of five or more variables (numerals). The only problems, however, would be the necessity of a very big board, since with five variables, the board would consist of 730 "men" for both players compared to 128 with four variables. (All else being equal, a five-variable game would be more than 5 times the size of a four-variable game). In a more than four variable game, it would be preferable to use only one section like the two to two's.

I claim:

1. A game apparatus comprising:

(a) at least ten distinct playing pieces each bearing means to indicate distinctness;

(b) a game board including at least one planar playing section, said at least one playing section including a first subsection having a first plurality of one-variable playing piece receiving means for receiving one playing piece, a second subsection having a second plurality of spaced apart two-variable playing piece receiving means for receiving two playing pieces, a third subsection having a third plurality of spaced apart three-variable playing piece receiving means for receiving three playing pieces, and a fourth subsection having a fourth plurality of spaced apart four-variable playing piece receiving means for receiving four playing pieces; and (c) chance means for determining which of said pieces may be played and in which of said subsections said pieces may be played.

2. The apparatus of claim 1, where the means to indicate distinctness comprise ten preselected colors.

3. The apparatus of claim 2, wherein the chance means include means for randomly indicating at least one of said preselected colors whereby the availability of a particular piece for play is determined.

4. The apparatus of claim 1, wherein the means to indicate distinctness comprise the ten one-digit numbers selected from the group consisting of 0, 1, 2, 3, 4, 5, 6, 7, 8 and 9.

5. The apparatus of claim 4, wherein the chance means include means for randomly indicating at least one of said one-digit numbers whereby the availability of a particular piece for play is determined.

6. The apparatus of claim 1, wherein said chance means comprise at least two distinct dice, the first distinct die bearing a one-digit number on five of its faces so that the sum of the five numbers is 23 with the sixth face of said die bearing the symbol plus (+), and the second distinct die bearing a one-digit number on five of its faces so that the sum of the five numbers is 22 with the sixth face of said die bearing the symbol minus (−).

7. The apparatus of claim 6, wherein each one-digit number includes means corresponding to one of the distinctness indicating means.

8. The apparatus of claim 6, wherein the face of the distinct die bearing the symbol plus (+) also bears at least one word having a positive meaning and wherein the face of the distinct die bearing the symbol minus (−) also bears at least one word having a negative meaning.

9. The apparatus of claim 1, wherein the playing piece receiving means are man-shaped.

10. A game apparatus comprising:

(a) a plurality of playing pieces;

(b) a game board including at least one playing section, said at least one playing section including a first plurality of playing piece receiving means, a second plurality of playing piece receiving means separate from said first plurality of playing piece receiving means, a third plurality of playing piece receiving means separate from said first and said second plurality of playing piece receiving means, and a fourth plurality of playing piece receiving means separate from the other playing piece receiving means, said first plurality of playing piece receiving means comprising means for receiving one-variable piece, said second plurality of playing piece receiving means comprising means for receiving two different variable pieces, said third plurality of playing piece receiving means comprising means for receiving three different variable playing pieces, and said fourth plurality of playing piece receiving means comprising means for receiving four different variable playing pieces; and (c) chance means for determining which of said pieces may be played and on which of said playing piece receiving means they may be played.

11. The apparatus of claim 10, wherein said first, said second, said third, and said fourth plurality of playing piece receiving means are arranged in separate, spaced apart subsections.

12. The apparatus of claim 11, wherein the subsection containing said second plurality of playing piece receiving means includes a first plurality of means for separating pairs of said second plurality of playing piece receiving means, and the subsection containing said third plurality of playing piece receiving means includes a second plurality of means for separating said third plurality of playing piece receiving means into four distinct groups.

13. The apparatus of claim 10, wherein the chance means comprise at least one die.

14. The apparatus of claim 10, wherein the playing pieces are colored spheres.

15. The apparatus of claim 13, wherein said at least one die bears a number on at least one face thereof and a symbol on at least one other face thereof.

16. The apparatus of claim 10, wherein said game board comprises two playing sections and a neutral section.

17. The apparatus of claim 11, wherein said chance means comprise at least one die which includes means for determining which of said pieces may be played on at least one of its faces and means for determining in which of said subsections a piece may be played on at least another one of its faces.

18. The apparatus of claim 11, wherein said chance means includes first means for determining which of said pieces may be played comprising a one-digit number and second means for determining in which of said subsections a piece may be played comprising at least two symbols, said first and second means being carried by at least one pair of dice.

19. The apparatus of claim 18, wherein the playing pieces comprise at least ten spheres with each sphere bearing one of ten preselected color indicia, wherein each one-digit number is colored to correspond to one of the ten preselected color indicia and wherein the at least two symbols are plus (+) and minus(−).

* * * * *